US008973215B2

(12) United States Patent
Makarov

(10) Patent No.: US 8,973,215 B2
(45) Date of Patent: Mar. 10, 2015

(54) CYCLONIC VACUUM CLEANER AND DIRT SEPARATOR

(75) Inventor: Sergey V. Makarov, Solon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 13/552,409

(22) Filed: Jul. 18, 2012

(65) Prior Publication Data

US 2014/0020205 A1 Jan. 23, 2014

(51) Int. Cl.
*A47L 9/16* (2006.01)

(52) U.S. Cl.
USPC ..... 15/353; 15/327.6; 55/DIG. 3; 55/337; 55/345; 55/459.1; 55/459.4; 55/459.5; 55/458

(58) Field of Classification Search
USPC ..... 15/353, 347, 327.6; 55/DIG. 3, 337, 55/345, 346, 349, 459.1, 459.4, 459.5, 458
See application file for complete search history.

(56) References Cited

U.S. PATENT DOCUMENTS

| | | | | |
|---|---|---|---|---|
| 3,710,554 | A | 1/1973 | Brookman | |
| 5,224,976 | A * | 7/1993 | Oranje | 55/399 |
| 6,141,826 | A | 11/2000 | Conrad et al. | |
| 6,334,234 | B1 | 1/2002 | Conrad et al. | |
| 6,344,064 | B1 | 2/2002 | Conrad | |
| 6,375,720 | B2 | 4/2002 | Embree et al. | |
| 6,376,732 | B1 | 4/2002 | Ngan et al. | |
| 6,391,095 | B1 | 5/2002 | Conrad et al. | |
| 6,398,973 | B1 | 6/2002 | Saunders et al. | |
| 6,428,589 | B1 * | 8/2002 | Bair et al. | 55/318 |
| 6,485,536 | B1 | 11/2002 | Masters | |
| 6,540,917 | B1 * | 4/2003 | Rachels et al. | 210/512.1 |
| 6,582,489 | B2 | 6/2003 | Conrad | |
| 6,818,033 | B2 | 11/2004 | North | |
| 6,837,912 | B1 * | 1/2005 | Heumann | 55/424 |
| 6,936,095 | B2 | 8/2005 | North | |
| 6,989,039 | B2 | 1/2006 | Vuijk | |
| 7,065,826 | B1 * | 6/2006 | Arnold | 15/353 |
| 7,258,713 | B2 | 8/2007 | Eubank et al. | |
| 7,279,020 | B2 | 10/2007 | Christiansen et al. | |
| 7,288,129 | B2 * | 10/2007 | Oh et al. | 55/426 |

(Continued)

FOREIGN PATENT DOCUMENTS

| | | |
|---|---|---|
| EP | 1772091 | 4/2007 |
| GB | 2287667 | 9/1995 |
| WO | 2012146616 | 11/2012 |

OTHER PUBLICATIONS

European Extended Search Report for Application No. 13193052 dated Feb. 2, 2014 (6 pages).

*Primary Examiner* — Monica Carter
*Assistant Examiner* — Andrew A Horton
(74) *Attorney, Agent, or Firm* — Michael Best & Friedrich LLP

(57) ABSTRACT

A vacuum cleaner operable to separate debris from an air stream. The vacuum cleaner includes a first cyclonic separator and a second cyclonic separator having an inlet configured to receive the air stream from the first cyclonic separator. The inlet of the second cyclonic separator directs the air steam in an inlet flow direction from an upper end of the first housing toward a lower end of the first housing and along a longitudinal axis into the second cyclonic separator. The inlet of the second cyclonic separator has an inlet cross-sectional area for flow of the air stream measured normal to the longitudinal axis that decreases in the inlet flow direction.

39 Claims, 6 Drawing Sheets

(56) References Cited

U.S. PATENT DOCUMENTS

| | | | | |
|---|---|---|---|---|
| 7,311,744 | B2 | 12/2007 | Elliott | |
| 7,335,241 | B2 * | 2/2008 | Oh et al. | 55/343 |
| 7,419,522 | B2 | 9/2008 | Arnold | |
| 7,445,651 | B2 * | 11/2008 | Lane et al. | 55/337 |
| 7,455,708 | B2 | 11/2008 | Conrad et al. | |
| 7,544,224 | B2 | 6/2009 | Tanner et al. | |
| 7,604,675 | B2 | 10/2009 | Makarov et al. | |
| 7,632,324 | B2 * | 12/2009 | Makarov et al. | 55/337 |
| 7,637,991 | B2 | 12/2009 | Eddington et al. | |
| 7,662,201 | B2 * | 2/2010 | Lee | 55/419 |
| 7,722,693 | B2 * | 5/2010 | Yoo et al. | 55/345 |
| 2004/0112018 | A1 * | 6/2004 | Vuijk | 55/346 |
| 2005/0155177 | A1 * | 7/2005 | Baer et al. | 15/353 |
| 2007/0011998 | A1 * | 1/2007 | Yoo et al. | 55/337 |
| 2007/0144116 | A1 * | 6/2007 | Hong et al. | 55/345 |
| 2007/0234687 | A1 | 10/2007 | Ni | |
| 2008/0047091 | A1 | 2/2008 | Nguyen | |
| 2008/0115469 | A1 * | 5/2008 | Lane et al. | 55/337 |
| 2008/0196197 | A1 * | 8/2008 | Conrad et al. | 15/353 |
| 2008/0289139 | A1 | 11/2008 | Makarov et al. | |
| 2009/0133370 | A1 | 5/2009 | Yoo et al. | |
| 2009/0217635 | A1 | 9/2009 | Bertram et al. | |
| 2009/0241491 | A1 | 10/2009 | Han et al. | |
| 2009/0265883 | A1 | 10/2009 | Reed, Jr. et al. | |
| 2009/0282791 | A1 * | 11/2009 | Lang | 55/326 |
| 2009/0300872 | A1 | 12/2009 | Griffith et al. | |
| 2009/0300874 | A1 | 12/2009 | Tran et al. | |

* cited by examiner

CYCLONIC VACUUM CLEANER AND DIRT SEPARATOR

BACKGROUND

The present invention relates to cyclonic vacuum cleaners.

Cyclonic vacuum cleaners often include a base or foot and an upright handle pivotally attached to the base. A dirt separator can be removably attached to the upright handle, and the dirt separator can include a first cyclonic stage, a second cyclonic stage downstream from the first cyclonic stage, and a dirt cup to collect dirt separated from the first and the second cyclonic stages. Dirt and air is often drawn through an inlet aperture in the base and transported to the dirt separator. The dirt and air enter the first cyclonic stage of the separator where cyclonic action separates dirt, which falls into the dirt cup, and the relatively clean air travels to the second cyclonic stage. In the second cyclonic stage, cyclonic action separates relatively fine dirt that still remains in the air. The relatively fine dirt falls into the dirt cup and the relatively clean air is discharged to the atmosphere.

SUMMARY

In one embodiment, the invention provides a vacuum cleaner operable to separate debris from an air stream. The vacuum cleaner includes a first housing having an upper end, a lower end, a first longitudinal axis, and an inner wall that surrounds the first longitudinal axis, and the inner wall at least partially defines a first cyclonic separator having an inlet configured to receive the air stream. A second housing is located at least partially within the first housing, and the second housing includes a second longitudinal axis and an inner wall that surrounds the second longitudinal axis, and the inner wall of the second housing at least partially defines a second cyclonic separator having an inlet configured to receive the air stream from the first cyclonic separator. The vacuum cleaner further includes a dirt cup in fluid communication with the first and second cyclonic separators, and the dirt cup is configured to receive the debris separated from the air stream by the first and second cyclonic separators. The inlet of the second cyclonic separator directs the air steam in an inlet flow direction from the upper end of the first housing toward the lower end of the first housing and along the second longitudinal axis into the second cyclonic separator. The inlet of the second cyclonic separator has an inlet cross-sectional area for flow of the air stream measured normal to the second longitudinal axis that decreases in the inlet flow direction.

In another embodiment the invention provides a vacuum cleaner operable to separate debris from an air stream. The vacuum cleaner includes a first housing having an upper end, a lower end, a first longitudinal axis and an inner wall that surrounds the first longitudinal axis, and the inner wall at least partially defines a first cyclonic separator having an inlet configured to receive the air stream. A second housing is located at least partially within the first housing, and the second housing includes a second longitudinal axis and an inner wall that surrounds the second longitudinal axis, and the inner wall of the second housing at least partially defines a second cyclonic separator having an inlet configured to receive the air stream from the first cyclonic separator. The vacuum cleaner further includes a dirt cup in fluid communication with the first and second cyclonic separators, and the dirt cup is configured to receive the debris separated from the air stream by the first and second cyclonic separators, and a vane extends at least partially around and along the second longitudinal axis and is located at least partially within the inlet of the second cyclonic separator. The vane is configured to rotate the air stream about the second longitudinal axis. An air outlet duct is in fluid communication with the second cyclonic separator to transport the air stream from the first cyclonic separator. The inlet of the second cyclonic separator directs the air steam in an inlet flow direction from the upper end of the first housing toward the lower end of the first housing along the second longitudinal axis and into the second cyclonic separator, an the air outlet duct transports the air stream from the first cyclonic separator in an outlet flow direction from the lower end of the first housing toward the upper end of the first housing along the second longitudinal axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
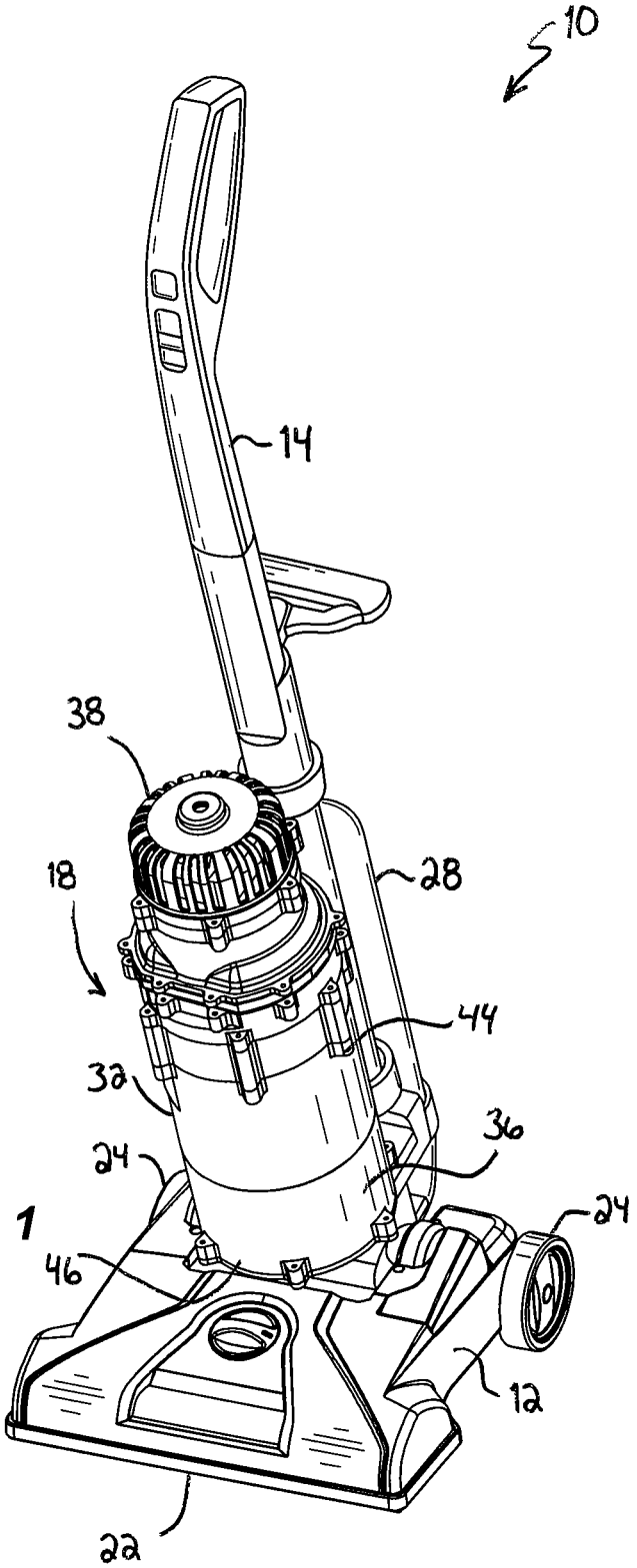
FIG. 1 is a perspective view of a vacuum cleaner according to one embodiment of the invention.

FIG. 1 illustrates a vacuum cleaner 10 that includes a base 12, a handle 14, and a dirt separator assembly 18. The base 12 includes a suction inlet 22 and wheels 24 to facilitate movement of the base 12 along a surface to be cleaned. In the illustrated embodiment, the handle 14 is pivotally coupled to the base 12 such that the handle 14 pivots relative to the base 12 between an upright storage position, which is illustrated in FIG. 1, and an inclined operating position. In the illustrated embodiment, a conduit 28 extends along the handle 14 and provides fluid communication between the suction inlet 22 and the dirt separator assembly 18.

Figure 2:
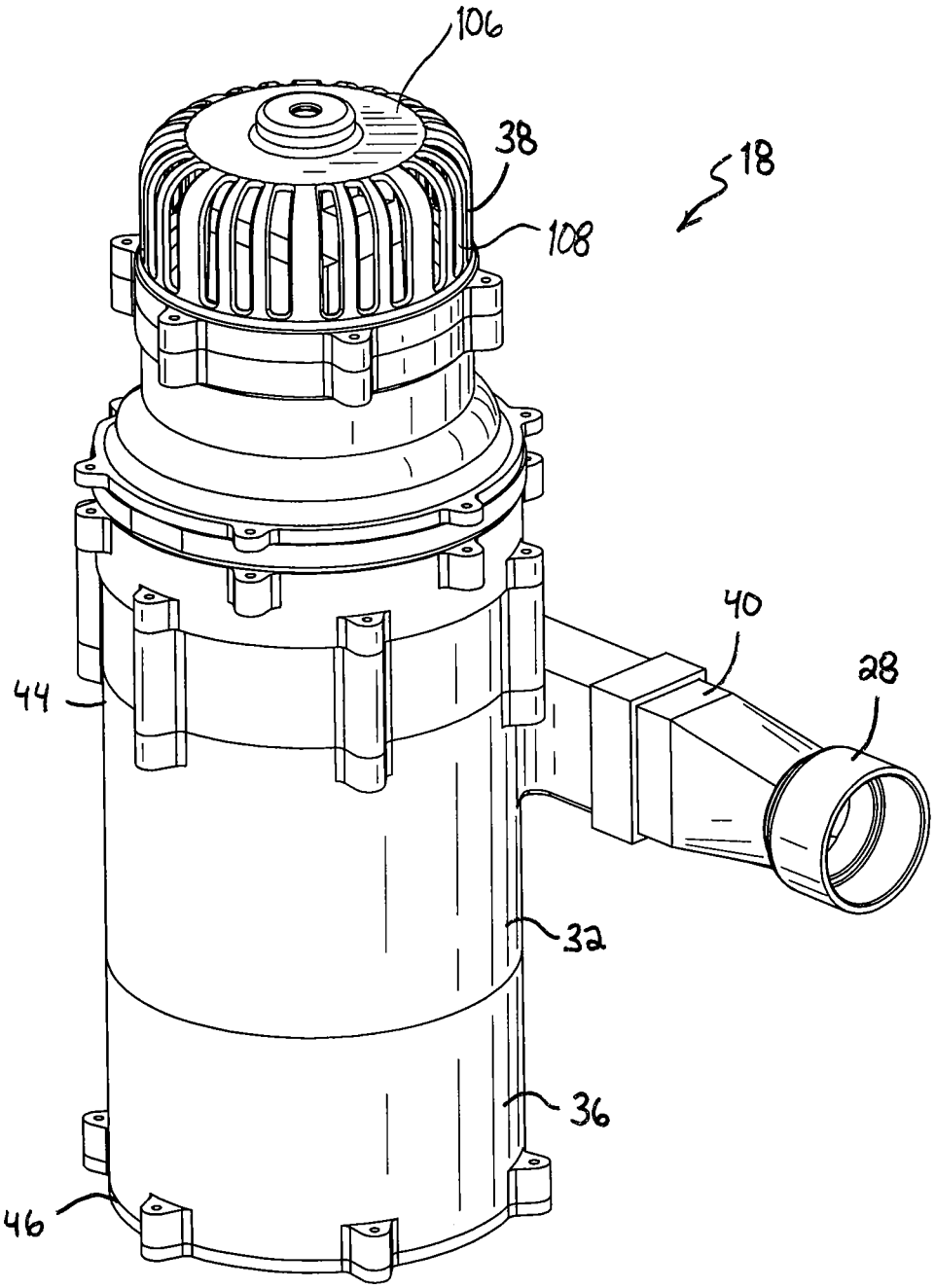
FIG. 2 is a perspective view of a dirt separator assembly of the vacuum cleaner of FIG. 1.
Figure 4:
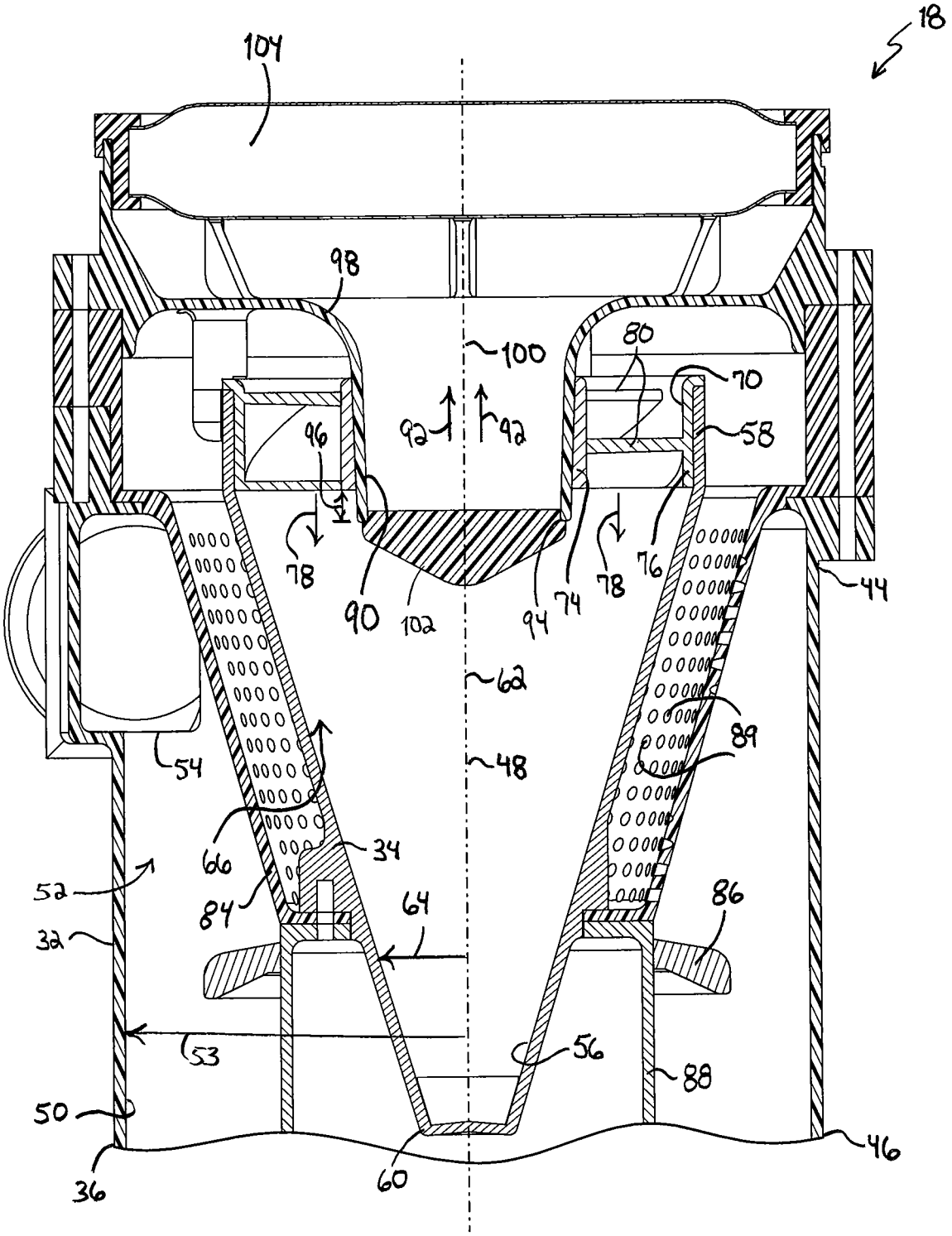
FIG. 4 is a cross-sectional view of a portion of the dirt separator assembly of FIG. 3 taken along line 4-4 of FIG. 3.

Referring to FIGS. 2 and 4, the dirt separator assembly 18 includes a first housing 32, a second housing 34, a dirt cup 36, a motor and fan assembly 38, and an inlet conduit 40. The illustrated first housing 32 forms an outer housing of the dirt separator assembly 18 and the outer housing 32 includes an upper end 44 and a lower end 46. The dirt cup 36 is coupled to the lower end 46 of the outer housing 32 and the inlet conduit 40 extends from the housing 32 adjacent the upper end 44 of the housing 32. The outer housing 32 further includes a longitudinal axis 48 that extends centrally through the upper end 44 and the lower end 46 of the housing 32. An inner wall 50 of the housing 32 surrounds the longitudinal axis 48 and defines a first cyclonic separator 52, which is a first stage separator in the illustrated embodiment. In the illustrated embodiment, the inner wall 50 is cylindrically shaped such that the inner wall 50 defines a radius 53 about the longitudinal axis 48 that is generally constant along the length of the inner wall 50 from the upper end 44 to the lower end 46. The first cyclonic separator 52 includes an inlet 54 adjacent the upper end 44 of the housing 32 and the inlet 54 is in fluid communication with the inlet conduit 40.

The second housing 34 forms an inner housing of the dirt separator assembly 18 in the illustrated embodiment, and the inner housing 34 is partially located within the outer housing 32. The housing 34 includes an inner wall 56 that is generally frusto-conically shaped in the illustrated embodiment. The housing 34 further includes an upper end 58 and a lower end 60 and the frusto-conical inner wall 56 is located between the ends 58 and 60. A longitudinal axis 62 of the housing 34 extends centrally through the ends 58 and 60 of the housing 34 and the inner wall 56 surrounds the axis 62 such that a radius 64 measured from the axis 62 to the inner wall 56 varies constantly along the axis 62 and is constant about the axis 62 at points along the axis 62. The inner wall 56 defines a second cyclonic separator 66, which is a second stage cyclonic separator in the illustrated embodiment. Although the illustrated embodiment includes only a single second stage cyclonic separator, in other embodiments, the dirt separator assembly 18 may include multiple second stage cyclonic separators. Also, the separator 66 is the final cyclonic stage of the separator 18 in the illustrated embodiment, but in other embodiments, the separator may include additional stages (e.g., a tertiary stage).

The second cyclonic separator 66 includes an inlet 70 that receives air from the first cyclonic separator 52. The illustrated inlet 70 is adjacent the upper end 44 of the outer housing 32 and the upper end 58 of the second housing 34. The inlet 70 includes an inner wall 74 and an outer wall 76. The inner wall 74 is generally cylindrical and surrounds the longitudinal axis 62 of the second cyclonic separator 66, and in the illustrated embodiment, the longitudinal axis 62 is concentric with the inner wall 74. The outer wall 76 surrounds the inner wall 74 and is also generally cylindrical and the outer wall 76 is concentric with the inner wall 74. The walls 74 and 76 guide an air stream in an inlet flow direction, generally represented by arrows 78 in FIG. 4, from the upper end 44 of the first housing 32 toward the lower end 46 of the first housing 32 along the longitudinal axis 62 of the second cyclonic separator 66. An inlet cross-sectional area for flow of the air stream is measured normal to the axis 62 between the walls 74 and 76, and in the illustrated embodiment, the inlet cross-sectional area for flow is an annular area.

Figure 3:
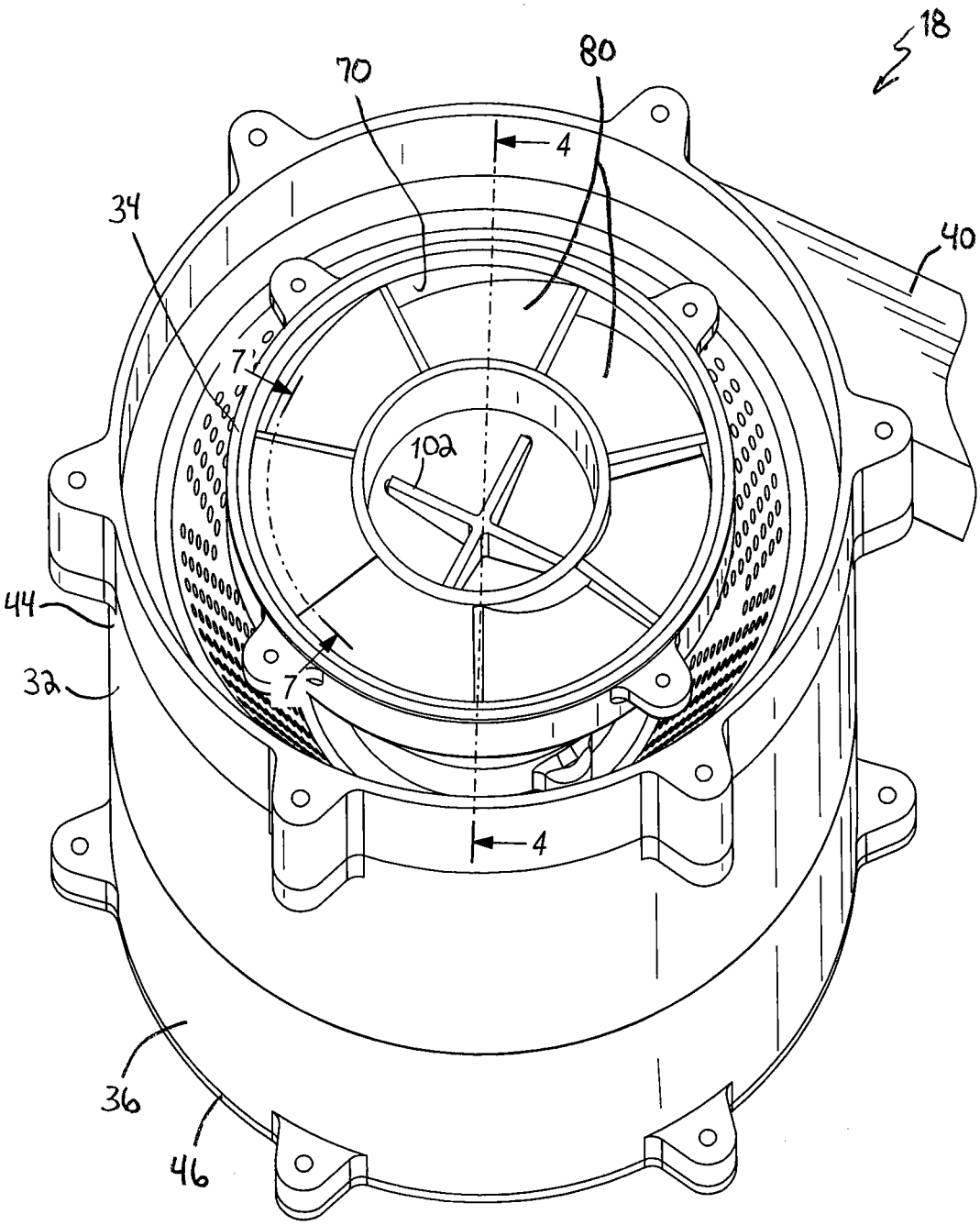
FIG. 3 is a perspective view of a portion of the dirt separator assembly of FIG. 2.

Referring to FIGS. 3 and 4, the inlet 70 further includes helical vanes 80 that extend through the inlet cross-sectional area and the vanes 80 are helical such that the vanes 80 extend around the longitudinal axis 62 and along the longitudinal axis 62 in the inlet flow direction 78. The vanes 80 extend from the inner wall 74 to the outer wall 76. The inlet 70 of the second cyclonic separator 66 directs the air stream in the inlet flow direction 78 from the upper end 44 of the first housing 32 toward the lower end 46 of the first housing 32 along the longitudinal axis 62 of the second cyclonic separator 66 and into the second cyclonic separator 66. Meanwhile, the vanes 80 rotate the air stream about the axis 62.

Referring to FIG. 4, the illustrated dirt separator assembly 18 includes a shroud 84, a skirt 86, and a support 88. The shroud 84 includes apertures 89 and the shroud 84 is located between the first cyclonic separator 52 and the second cyclonic separator 66 to filter any remaining relatively large debris in the air stream between the first and second separator 52 and 66. The skirt 86 is attached to the support 88 and the skirt 86 minimizes the amount of debris in the dirt cup 36 that becomes re-entrained in the air stream by minimizing the airflow past the skirt 86 between the dirt cup 36 and the first cyclonic separator 52. The support 88 extends from a lower wall of the dirt cup 36 to support the shroud 84, the skirt 86 and the inner housing 34 within the outer housing 32.

The dirt cup 36 is located below the first and second cyclonic separators 52 and 66 to receive and collect dirt and debris separated from the air stream by the separators 52 and 66. The dirt cup 36 is located adjacent the lower end 46 of the outer housing 32.

Referring to FIG. 4, the dirt separator assembly 18 further includes an air outlet duct 90. The air outlet duct 90 is in fluid communication with the second cyclonic separator 66 to transport the air stream from the second cyclonic separator 66 in an outlet flow direction, generally represented by arrow 92 in FIG. 4, in a direction from the lower end 46 of the outer housing 32 toward the upper end 44 of the outer housing 32 along the longitudinal axis 62 of the second cyclonic separator 66. The outlet duct 90 includes an inlet 94 that is located within the second cyclonic separator 66 in the illustrated embodiment. Therefore, the inlet 94 is spaced a distance 96 measured parallel to the longitudinal axis 62 in the inlet flow direction from the air inlet 70 of the second cyclonic separator 66 to define a gap between the inlet 94 of the air outlet duct 90 and the inlet 70 of the second cyclonic separator 66. The gap, represented by the distance 96, minimizes the amount of air from the air stream that by-passes the second cyclonic separator 66 and travels from the inlet 70 directly into the outlet duct 90 without traveling through the separator 66 to remove debris from the air stream.

The air outlet duct 90 further includes an outlet 98, and in the illustrated embodiment, the outlet 98 is formed as a divergent nozzle. A longitudinal axis 100 extends centrally through the inlet 94 and the outlet 98, and in the illustrated embodiment, the longitudinal axis 100 is co-axial with the longitudinal axis 62 of the second cyclonic separator 66. And, in the illustrated embodiment, the outlet duct 90 extends through the inlet 70 such that the inner wall 74 of the inlet 70 surrounds the outlet duct 90. The air outlet duct 90 further includes a flow straightening member 102 that straightens the air stream (i.e., reduces swirling) as it travels through the duct 90.

With continued reference to FIG. 4, the dirt separator assembly 18 further includes a filter 104. The illustrated filter 104 is a pre-motor filter (i.e., positioned upstream of the motor and fan assembly 38). The filter 104 can include a pleated filter, foam filter, and the like. Furthermore, although only one filter 104 is illustrated in FIG. 4, the assembly 18 can include more the one filter (i.e., multiple stage filters). The divergent nozzle 98 of the outlet duct 90 expands the air stream in a direction generally normal to the axis 100 before the air stream travels through the filter 104 to maximize the surface area of the filter 104 that is utilized to filter the air stream.

Referring to FIGS. 1 and 2, the motor and fan assembly 38 is coupled to the outer housing 32 adjacent the upper end 44 of the housing 32 and the assembly 38 includes a motor housing 106 having exhaust vents 108. The motor and fan assembly 38 operates as a suction source to generate the air stream. In the illustrated embodiment, the motor and fan assembly 38 is coupled to the housing 32 such that the motor and fan assembly 38 is removable from the handle 14 and the base 12 with the dirt separator assembly 18 as a single component. Also, in the illustrated embodiment, the motor and fan assembly includes a direct current (DC) motor powered by a rechargeable battery (e.g., lithium-ion rechargeable battery). In other embodiments, the motor and fan assembly can be powered by 120 volt alternating current.

In operation, the user provides power to the motor and fan assembly 38, such as by operating a switch, which generates the air stream. The air stream draws dirt and debris along with the air stream through the suction inlet 22. The air stream, entrained with dirt and debris, travels up the conduit 28. Referring to FIG. 4, the air stream then enters the first cyclonic separator 52 through the inlet 54. Cyclonic action causes relatively heavy dirt and debris to be separated from the air stream and fall into the dirt cup 36 (FIG. 2). The air stream the travels through the apertures 89 of the shroud 84 and into the inlet 70. The inlet 70 guides the air stream in the inlet flow direction 78 and the helical vanes 80 rotate the air stream about the axis 62. The air stream enters the second cyclonic separator 66 where cyclonic action separates relatively fine dust and debris from the air stream. The separated dust and debris falls via gravity into the dirt cup 36 and the relatively clean air stream travels in the outlet flow direction 92 into the outlet duct 90. The air stream is further cleaned by the filter 104 before being exhausted to the atmosphere through the exhaust vents 108 in the motor housing 106.

Figure 5A:
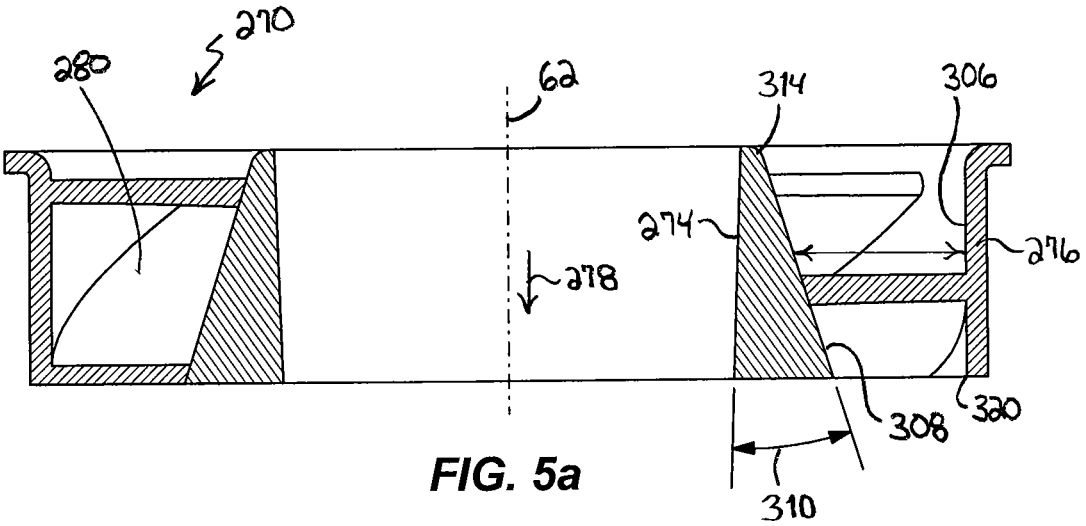
FIG. 5*a* is a cross-sectional view of an inlet for a second cyclonic separator for a dirt separator according to another embodiment.
Figure 5B:
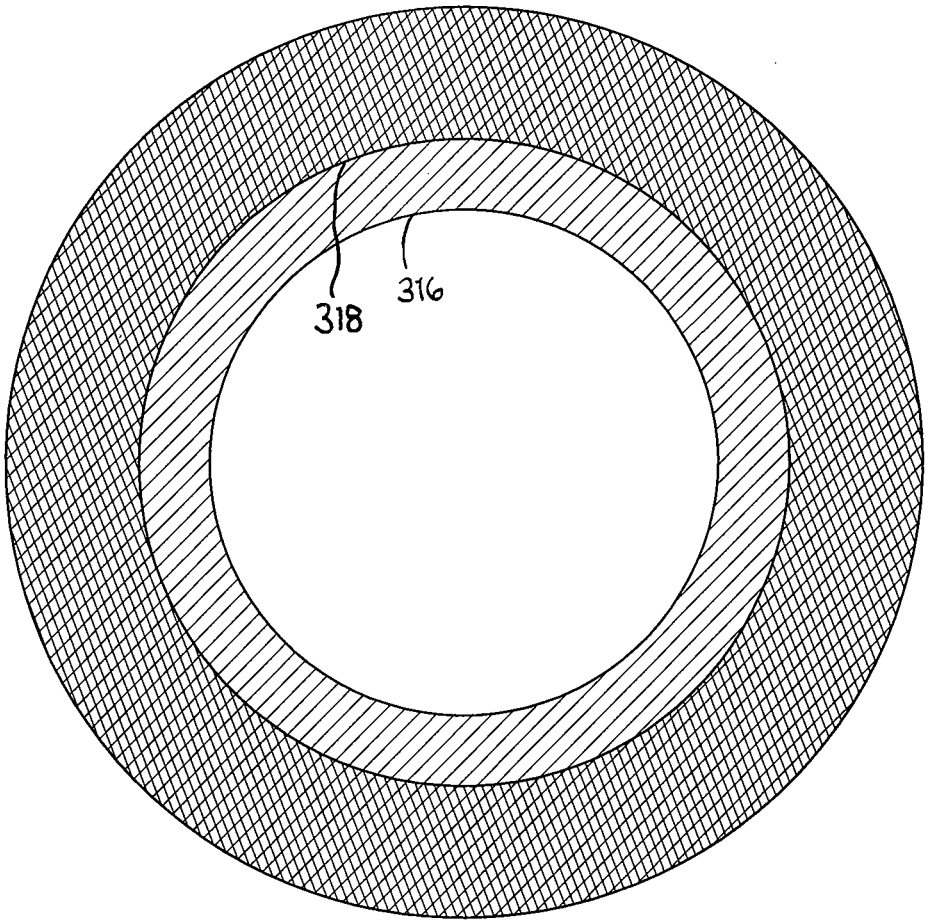
FIG. 5*b* schematically illustrates an inlet cross-sectional area for the inlet of FIG. 5*a*

FIG. 5*a* illustrates an inlet 270 according to another embodiment for use with the dirt separator assembly 18. The inlet 270 of FIG. 5*a* is similar to the inlet 70 of FIGS. 1-4. Accordingly, only differences between the inlets 70 and 270 will be discussed in detail below and like components having been given like reference numbers plus 200. The axial inlet 270 includes an outer wall 276 having an inner surface 306 along which the air stream travels, and the inner surface 306 faces an inner surface 308 of the inner wall 274 along which the air stream travels. The inner surface 306 of the outer wall 276 is generally parallel to the axis 62 when the inlet 270 is used with the dirt separator assembly 18 described above, and the inner surface 308 of the inner wall 274 is at an acute angle 310 with respect to the axis 62 as illustrated in FIG. 5. In the illustrated in embodiment, the angle 310 is about 20 degrees. In other embodiments, the angle 310 can range from about 10 degrees to about 30 degrees. The inner wall 274 tapers in the inlet flow direction 278 such that a distance 312 between the walls 274 and 276 measured normal to the axis 62 decreases in the inlet flow direction 278 to decrease the inlet cross-sectional area for the flow of the air stream. Alternatively stated, referring to FIGS. 5*a* and 5*b*, an upstream end 314 of the inlet 270 has an upstream cross-sectional area 316 for flow of the air stream greater than a downstream cross-sectional area 318 for flow at a downstream end 320. A flow area ratio is defined as the area 316 divided by the area 318, and in the illustrated embodiment, the flow area ratio is about 1.4, and in other embodiments the flow area ratio is in the range from 1.2 to 1.6, and in yet other embodiments, the flow area ratio is greater than 1. Thus, the axial inlet 270 of FIG. 5*a* converges from the upstream end 314 to the downstream end 320 to increase the velocity of the air stream as it travels through the inlet 270.

Figure 6:
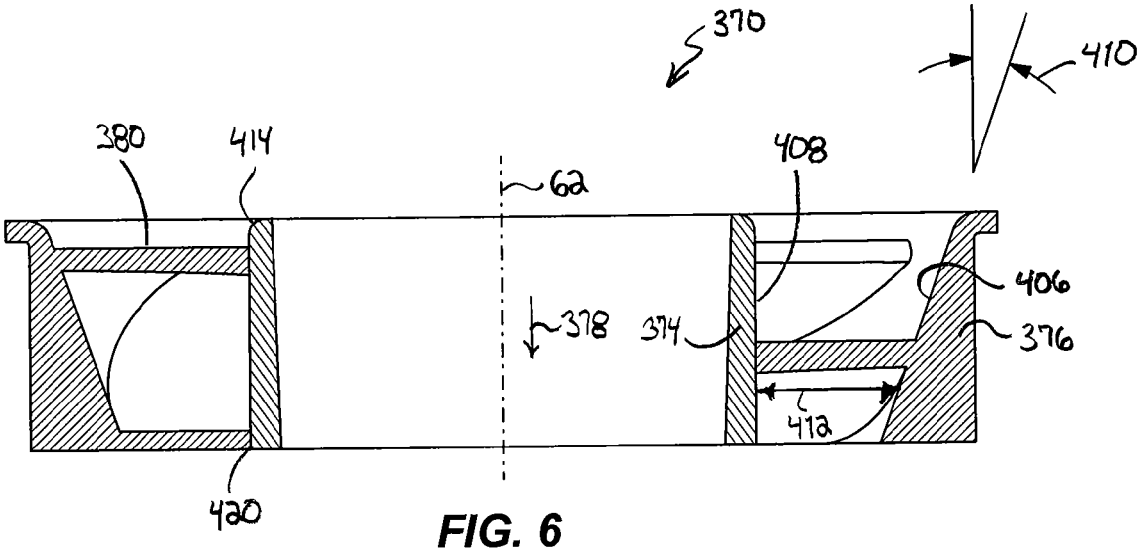
FIG. 6 is a cross-sectional view of an inlet for a second cyclonic separator for a dirt separator according to yet another embodiment.

FIG. 6 illustrates an inlet 370 according to another embodiment for use with the dirt separator assembly 18. The inlet 370 of FIG. 6 is similar to the axial inlet 270 of FIGS. 5*a* and 5*b*. Accordingly, only differences between the inlets 270 and 370 will be discussed in detail below and like components having been given like reference numbers plus 100. The axial inlet 370 includes an outer wall 376 having an inner surface 406 along which the air stream travels, and the inner surface 406 faces an inner surface 408 of an inner wall 374 along which the air stream travels. The inner surface 408 of the inner wall 374 is generally parallel to the axis 62 when the inlet 370 is used with the dirt separator assembly 18 described above, and the inner surface 406 of the outer wall 376 is at an acute angle 410 with respect to the axis 62 as illustrated in FIG. 6. In the illustrated in embodiment, the angle 410 is about 20 degrees. In other embodiments, the angle 410 can range from about 10 degrees to about 30 degrees. The outer wall 376 tapers in the inlet flow direction 378 such that a distance 412 between the walls 374 and 376 measured normal to the axis 62 decreases in the inlet flow direction 378 to decrease the inlet cross-sectional area for the flow of the air stream. Alternatively stated, an upstream end 414 of the inlet 370 has an upstream cross-sectional area for flow of the air stream greater than a downstream cross-sectional area for flow at a downstream end 420. A flow area ratio is defined as the upstream cross-sectional area divided by the downstream cross-sectional area, and in the illustrated embodiment the flow area ratio is about 1.4, and in other embodiments the flow area ratio is in the range from 1.2 to 1.6, and in yet other embodiments, the flow area ratio is greater than 1. Thus, the axial inlet 370 of FIG. 6 converges from the upstream end 414 to the downstream end 420 to increase the velocity of the air stream as it travels through the inlet 370.

Figure 7:
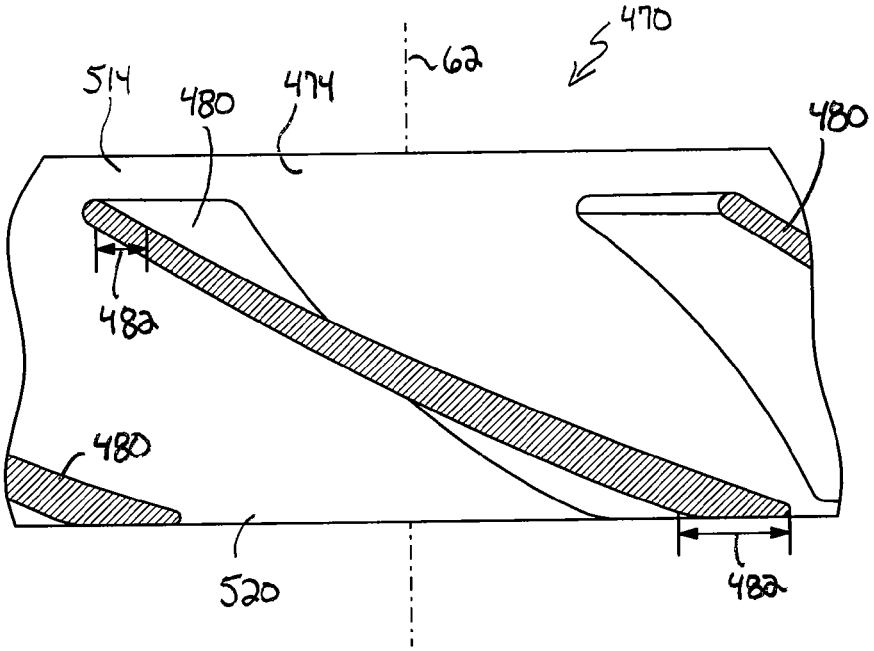
FIG. 7 is a cross-sectional view taken along lines 7-7 of FIG. 3 but illustrating an inlet for a second cyclonic separator for a dirt separator according to yet another embodiment.

FIG. 7 illustrates an inlet 470 according to another embodiment for use with the dirt separator assembly 18. The axial inlet 470 of FIG. 7 is similar to the axial inlet 70 of FIGS. 1-4. Accordingly, only differences between the inlets 70 and 470 will be discussed in detail below and like components having been given like reference numbers plus 400. The inlet 470 includes helical vanes 480 having a vane thickness 482, measured around the longitudinal axis 62 and normal to the axis 62 as illustrated in FIG. 7. The vane thickness 482 increases from an upstream end 514 of the inlet 470 to a downstream end 520 of the inlet 470. Because the vanes 480 are thinner at the upstream end 514 and thicker at the downstream end 520, an upstream cross-sectional flow area defined between adjacent vanes 480 is greater than a downstream end cross-sectional flow area. Thus, the flow area at the upstream end 514 converges toward the downstream end 520 to increase the velocity of the air stream as it travels through the inlet 470. The helical vanes 470 of FIG. 7 with variable vane thickness 482 may be used with any of the inlets 70, 270, and 370 described herein.

Various features and advantages of the invention are set forth in the following claims.

What is claimed is:

1. A vacuum cleaner operable to separate debris from an air stream, the vacuum cleaner comprising:

a first housing having an upper end, a lower end, a first longitudinal axis, and an inner wall that surrounds the first longitudinal axis, and the inner wall at least partially defines a first cyclonic separator having an inlet configured to receive the air stream;

a second housing located at least partially within the first housing, the second housing including a second longitudinal axis and an inner wall that surrounds the second longitudinal axis, and the inner wall of the second housing at least partially defines a second cyclonic separator having an inlet configured to receive the air stream from the first cyclonic separator, the inlet of the second cyclonic separator having opposed upper and lower ends along the second longitudinal axis;

a dirt cup in fluid communication with the first and second cyclonic separators, the dirt cup configured to receive the debris separated from the air stream by the first and second cyclonic separators; and a vane that extends around the second longitudinal axis located within the inlet of the second cyclonic separator, wherein the inlet of the second cyclonic separator directs the air steam in an inlet flow direction from the upper end of the first housing toward the lower end of the first housing and along the second longitudinal axis into the second cyclonic separator, wherein the inlet of the second cyclonic separator has an inlet cross-sectional area for flow of the air stream measured normal to the second longitudinal axis that gradually decreases in a direction from the upper end of the inlet to the lower end of the inlet, wherein the inlet of the second cyclonic separator includes an inner wall that direct the air stream in the inlet flow direction and surrounds the second longitudinal axis and an outer wall that directs the air steam in the inlet flow direction and surrounds the inner wall of the inlet for the second cyclonic separator, wherein the inlet cross-sectional area extends from the inner wall of the inlet to the outer wall of the inlet such that the inlet cross-sectional area is an annular area, and wherein the vane is a first vane, the vacuum cleaner further comprising a second vane that extends around the second longitudinal axis and in the inlet flow direction located within the inlet of the second cyclonic separator adjacent the first vane, and wherein a thickness of the first vane is measured around the second longitudinal axis and normal to the second longitudinal axis, and wherein the thickness of the first vane increases in the inlet flow direction to decrease the inlet cross-sectional area for the flow of the air stream in the inlet flow direction.

2. The vacuum cleaner of claim 1, wherein the inner wall of the inlet of the second cyclonic separator tapers in the direction of the second longitudinal axis such that a distance between the inner wall of the inlet and the outer wall of the inlet measured normal to the second longitudinal axis decreases in the inlet flow direction to decrease the inlet cross-sectional area for the flow of the air stream in the inlet flow direction.

3. The vacuum cleaner of claim 1, wherein the outer wall of the inlet of the second cyclonic separator tapers in the direction of the second longitudinal axis such that a distance between the inner wall of the inlet and the outer wall of the inlet measured normal to the second longitudinal axis decreases in the inlet flow direction to decrease the inlet cross-sectional area for the flow of the air stream in the inlet flow direction.

4. The vacuum cleaner of claim 1, wherein the vane extends from the inner wall of the inlet of the second cyclonic separator to the outer wall of the inlet.

5. The vacuum cleaner of claim 1, wherein the first longitudinal axis and the second longitudinal axis are co-axial.

6. The vacuum cleaner of claim 1, further comprising an air outlet duct in fluid communication with the second cyclonic separator to transport the air stream from the second cyclonic separator in an outlet flow direction from the lower end of the first housing toward the upper end of the first housing along the second longitudinal axis.

7. The vacuum cleaner of claim 6, wherein the air outlet duct includes an inlet located within the second cyclonic separator, wherein the inlet of the air outlet duct is spaced a distance measured parallel to the second longitudinal axis in the inlet flow direction from the air inlet of the second cyclonic separator to define a gap between the inlet of the air outlet duct and the inlet of the secondary cyclonic separator.

8. The vacuum cleaner of claim 1, further comprising a suction motor and fan assembly coupled to the first housing above the dirt cup.

9. The vacuum cleaner of claim 8, further comprising a motor housing including exhaust vents, the motor housing at least partially surrounding the suction motor and fan assembly.

10. The vacuum cleaner of claim 1, further comprising a suction motor and fan assembly and a battery configured to power the suction motor and fan assembly.

11. The vacuum cleaner of claim 10, wherein the suction motor and fan assembly is coupled to the first housing above the dirt cup.

12. A vacuum cleaner operable to separate debris from an air stream, the vacuum cleaner comprising:

a first housing having an upper end, a lower end, a first longitudinal axis, and an inner wall that surrounds the first longitudinal axis, and the inner wall at least partially defines a first cyclonic separator having an inlet configured to receive the air stream;

a second housing located at least partially within the first housing, the second housing including a second longitudinal axis and an inner wall that surrounds the second longitudinal axis, and the inner wall of the second housing at least partially defines a second cyclonic separator having an inlet configured to receive the air stream from the first cyclonic separator, the inlet of the second cyclonic separator having opposed upper and lower ends along the second longitudinal axis;

a dirt cup in fluid communication with the first and second cyclonic separators, the dirt cup configured to receive the debris separated from the air stream by the first and second cyclonic separators;

a vane that extends at least partially around and along the second longitudinal axis and located at least partially within the inlet of the second cyclonic separator, the vane configured to rotate the air stream about the second longitudinal axis;

an air outlet duct in fluid communication with the second cyclonic separator to transport the air stream from the second cyclonic separator, wherein the inlet of the second cyclonic separator directs the air steam in an inlet flow direction from the upper end of the first housing toward the lower end of the first housing along the second longitudinal axis and into the second cyclonic separator, wherein the air outlet duct transports the air stream from the second cyclonic separator in an outlet flow direction that is opposite to the inlet flow direction, wherein the inlet of the second cyclonic separator has an inlet cross-sectional area for flow of the air stream measured normal to the second longitudinal axis that gradually decreases in a direction from the upper end of the inlet to the lower end of the inlet, and wherein a thickness of the vane is measured around the second longitudinal axis and normal to the second longitudinal axis, such that the thickness of the vane increases to decrease the inlet cross-sectional area for the flow of the air.

13. The vacuum cleaner of claim 12, wherein the air outlet duct includes an inlet located within the second cyclonic separator, wherein the inlet of the air outlet duct is spaced a distance measured parallel to the second longitudinal axis in the inlet flow direction from the air inlet of the second cyclonic separator to define a gap between the inlet of the air outlet duct and the inlet of the secondary cyclonic separator.

14. The vacuum cleaner of claim 12, wherein the air outlet duct includes a flow straightening member configured to straighten the air stream in the air outlet duct.

15. The vacuum cleaner of claim 12, further comprising a suction motor and fan assembly coupled to and adjacent the upper end of the first housing.

16. The vacuum cleaner of claim 15, further comprising a base including a suction inlet and a handle pivotally coupled to the base, wherein the first and second housing are removably coupled to the handle and the base, and wherein the suction motor and fan assembly is coupled to the first housing such that the suction motor and fan assembly is removable from the base and the handle with the first and second housings.

17. The vacuum cleaner of claim 12, wherein the air outlet duct includes a divergent discharge nozzle.

18. The vacuum cleaner of claim 12, wherein the air outlet duct includes a longitudinal axis that extends centrally through the air outlet duct in the outlet flow direction, and wherein the longitudinal axis of the air outlet duct is co-axial with the second longitudinal axis.

19. The vacuum cleaner of claim 12, wherein the inlet of the second cyclonic separator has an inlet cross-sectional area for flow of the air stream measured normal to the second longitudinal axis, wherein the inlet of the second cyclonic separator includes an inner wall that direct the air stream in the inlet flow direction and surrounds the second longitudinal axis and an outer wall that directs the air steam in the inlet flow direction and surrounds the inner wall of the inlet for the second cyclonic separator, wherein the inlet cross-sectional area extends from the inner wall of the inlet to the outer wall of the inlet such that the inlet cross-sectional area is an annular area.

20. The vacuum cleaner of claim 19, wherein the inner wall of the inlet of the second cyclonic separator surrounds the air outlet duct.

21. A vacuum cleaner operable to separate debris from an air stream, the vacuum cleaner comprising:

a housing including a longitudinal axis and a cyclonic separator having an axial inlet configured to receive the air stream, the axial inlet having opposed upper and lower ends along the longitudinal axis;

a dirt cup in fluid communication with the cyclonic separator, the dirt cup configured to receive the debris separated from the air stream by the cyclonic separator;

a vane that extends at least partially around the longitudinal axis and in the inlet flow direction located within the axial inlet of the cyclonic separator, wherein the axial inlet of the cyclonic separator directs the air steam in an inlet flow direction along the longitudinal axis into the cyclonic separator, wherein the axial inlet of the cyclonic separator has an inlet cross-sectional area for flow of the air stream measured normal to the longitudinal axis that gradually decreases in in a direction from the upper end of the inlet to the lower end of the inlet, wherein the axial inlet of the cyclonic separator includes an inner wall that direct the air stream in the inlet flow direction and surrounds the longitudinal axis and an outer wall that directs the air steam in the inlet flow direction and surrounds the inner wall of the axial inlet for the cyclonic separator, wherein the inlet cross-sectional area extends from the inner wall of the axial inlet to the outer wall of the axial inlet such that the inlet cross-sectional area is an annular area, wherein the vane extends from the inner wall of the axial inlet of the cyclonic separator to the outer wall of the axial inlet, and wherein the vane is a first vane, the vacuum cleaner further comprising a second vane that extends around the longitudinal axis and in the inlet flow direction located within the axial inlet of the cyclonic separator adjacent the first vane, and wherein a thickness of the first vane is measured around the longitudinal axis and normal to the longitudinal axis, and wherein the thickness of the first vane increases in the inlet flow direction to decrease the inlet cross-sectional area for the flow of the air stream in the inlet flow direction.

22. The vacuum cleaner of claim 21, wherein the inner wall of the axial inlet of the cyclonic separator tapers in the direction of the longitudinal axis such that a distance between the inner wall of the axial inlet and the outer wall of the axial inlet measured normal to the longitudinal axis decreases in the inlet flow direction to decrease the inlet cross-sectional area for the flow of the air stream in the inlet flow direction.

23. The vacuum cleaner of claim 21, wherein the outer wall of the axial inlet of the cyclonic separator tapers in the inlet flow direction such that a distance between the inner wall of the axial inlet and the outer wall of the axial inlet measured normal to the longitudinal axis decreases in the inlet flow direction to decrease the inlet cross-sectional area for the flow of the air stream in the inlet flow direction.

24. The vacuum cleaner of claim 21, wherein portions of the first vane and the second vane overlap each other in the longitudinal direction.

25. The vacuum cleaner of claim 21, further comprising an air outlet duct at least partially disposed within the inner wall of the axial inlet, wherein the air outlet duct is in fluid communication with the cyclonic separator to transport the air stream from the cyclonic separator in an outlet flow direction along the longitudinal axis.

26. The vacuum cleaner of claim 25, wherein the air outlet duct includes an inlet located within the cyclonic separator, wherein the inlet of the air outlet duct is spaced a distance measured parallel to the longitudinal axis in the inlet flow direction from the axial inlet of the cyclonic separator to define a gap between the inlet of the air outlet duct and the axial inlet of the cyclonic separator.

27. The vacuum cleaner of claim 25, wherein the air outlet duct includes a divergent discharge nozzle.

28. The vacuum cleaner of claim 21, further comprising a suction motor and fan assembly coupled to the housing above the dirt cup.

29. The vacuum cleaner of claim 21, further comprising a suction motor and fan assembly and a battery configured to power the suction motor and fan assembly.

30. The vacuum cleaner of claim 29, wherein the suction motor and fan assembly is coupled to the housing above the dirt cup.

31. A vacuum cleaner operable to separate debris from an air stream, the vacuum cleaner comprising:

a housing including a longitudinal axis and a cyclonic separator having an inlet configured to receive the air stream, wherein the inlet of the cyclonic separator directs the air steam in an inlet flow direction along the longitudinal axis and into the cyclonic separator;

a dirt cup in fluid communication with the cyclonic separator, the dirt cup configured to receive the debris separated from the air stream by the cyclonic separator; and a plurality of vanes, wherein each of the plurality of vanes extends at least partially around and along the longitudinal axis and located at least partially within the inlet of the cyclonic separator, the plurality of vanes configured to rotate the air stream about the longitudinal axis, wherein portions of at least two adjacent vanes of the plurality of vanes overlap with each other in the longitudinal direction, wherein the inlet of the cyclonic separator has an inlet cross-sectional area for flow of the air stream measured normal to the longitudinal axis, wherein the inlet cross-sectional area gradually decreases in the inlet flow direction, and wherein a thickness of at least one of the plurality of vanes is measured around the longitudinal axis and normal to the longitudinal axis, and wherein the thickness of the at least one of the plurality of vanes increases in the inlet flow direction to decrease the inlet cross-sectional area for the flow of the air stream in the inlet flow direction.

32. The vacuum cleaner of claim 31, wherein the axial inlet of the cyclonic separator includes an inner wall that direct the air stream in the inlet flow direction and surrounds the longitudinal axis and an outer wall that directs the air steam in the inlet flow direction and surrounds the inner wall of the axial inlet for the cyclonic separator, wherein the inlet cross-sectional area extends from the inner wall of the axial inlet to the outer wall of the axial inlet such that the inlet cross-sectional area is an annular area.

33. The vacuum cleaner of claim 31, wherein the inner wall of the axial inlet of the cyclonic separator tapers in the direction of the longitudinal axis such that a distance between the inner wall of the axial inlet and the outer wall of the axial inlet measured normal to the longitudinal axis decreases in the inlet flow direction to decrease the inlet cross-sectional area for the flow of the air stream in the inlet flow direction.

34. The vacuum cleaner of claim 33, further comprising an air outlet duct at least partially disposed within the inner wall of the axial inlet, wherein the air outlet duct is in fluid communication with the cyclonic separator to transport the air stream from the cyclonic separator in an outlet flow direction along the longitudinal axis.

35. The vacuum cleaner of claim 34, wherein the air outlet duct includes a divergent discharge nozzle.

36. The vacuum cleaner of claim 33, wherein the air outlet duct includes an inlet located within the cyclonic separator, wherein the inlet of the air outlet duct is spaced a distance measured parallel to the longitudinal axis in the inlet flow direction from the axial inlet of the cyclonic separator to define a gap between the inlet of the air outlet duct and the axial inlet of the cyclonic separator.

37. The vacuum cleaner of claim 31, further comprising a suction motor and fan assembly coupled to the housing above the dirt cup.

38. The vacuum cleaner of claim 31, further comprising a suction motor and fan assembly and a battery configured to power the suction motor and fan assembly.

39. The vacuum cleaner of claim 38, wherein the suction motor and fan assembly is coupled to the housing above the dirt cup.

* * * * *